US011276953B2

(12) United States Patent
Meyer

(10) Patent No.: US 11,276,953 B2
(45) Date of Patent: Mar. 15, 2022

(54) REMOVABLE-REPLACEABLE PROTECTOR AND METHOD

(71) Applicant: Luke A. Meyer, Neenah, WI (US)

(72) Inventor: Luke A. Meyer, Neenah, WI (US)

( * ) Notice: Subject to any disclaimer, the term of this patent is extended or adjusted under 35 U.S.C. 154(b) by 0 days.

(21) Appl. No.: 16/865,521

(22) Filed: May 4, 2020

(65) Prior Publication Data

US 2020/0358220 A1 Nov. 12, 2020

Related U.S. Application Data

(60) Provisional application No. 62/843,963, filed on May 6, 2019.

(51) Int. Cl.

| | |
|---|---|
| ***H01R 13/502*** | (2006.01) |
| ***H01R 13/516*** | (2006.01) |
| ***H01R 13/58*** | (2006.01) |
| ***H01R 13/52*** | (2006.01) |

(52) U.S. Cl.

CPC ..... *H01R 13/5025* (2013.01); *H01R 13/516* (2013.01); *H01R 13/58* (2013.01); *H01R 13/5213* (2013.01)

(58) Field of Classification Search

CPC H01R 13/562; H01R 13/5213; H01R 13/516; H01R 13/58; H01R 13/5025; H01R 13/5804; H01R 13/60; H01R 31/00; H01R 33/97

See application file for complete search history.

(56) References Cited

U.S. PATENT DOCUMENTS

| | | | | |
|---|---|---|---|---|
| 3,030,601 | A | 4/1962 | Krebs | |
| 4,869,683 | A | 9/1989 | Nelson | |
| 7,867,015 | B1 * | 1/2011 | Parker | H02G 3/22 439/465 |
| 9,071,009 | B2 * | 6/2015 | Ardisana | H01R 13/5812 |
| 9,331,423 | B2 * | 5/2016 | Siahaan | H01R 13/5804 |
| 9,362,674 | B1 * | 6/2016 | Don | H01R 13/6392 |
| 10,361,507 | B2 * | 7/2019 | Zaytoun, Jr. | H02J 7/0042 |
| 10,826,223 | B2 * | 11/2020 | Drost | H01R 13/53 |
| 2015/0018052 | A1 * | 1/2015 | Baschnagel | H05K 5/0204 455/575.1 |

(Continued)

FOREIGN PATENT DOCUMENTS

| | | | |
|---|---|---|---|
| CN | 203260781 | U | 10/2013 |
| CN | 105576435 | A | 5/2016 |

(Continued)

OTHER PUBLICATIONS

Aliexpress, "Protector Saver Cover Compatible Apple IPhone USB Charger Cable Cord PVC Soft Rubber Protector for Data Line Earphone Wire", published on or before Jan. 28, 2019.

(Continued)

*Primary Examiner* — Briggitte R. Hammond
(74) *Attorney, Agent, or Firm* — Epiphany Law

(57) ABSTRACT

A removable-replaceable protector for a cable secured to a plug. The protector includes a resiliently-flexible sleeve positionable over the cable and the plug, the sleeve having a longitudinal slit extending along the sleeve. The protector also includes a resiliently-rigid clip positionable over the resiliently-flexible sleeve and super imposed over the plug, the clip having a longitudinal slot extending along the clip.

22 Claims, 5 Drawing Sheets

(56) References Cited

U.S. PATENT DOCUMENTS

2016/0190730 A1* 6/2016 Huang ..... H01R 13/502
439/445

FOREIGN PATENT DOCUMENTS

| | | |
|---|---|---|
| CN | 205752772 U | 11/2016 |
| CN | 207282182 U | 4/2018 |
| CN | 207559238 U | 6/2018 |

OTHER PUBLICATIONS

Amazon; "TUPARKA 22 Pcs Charger Cable Protector, Plastic Cute Fish Animal Unicorn Charging Cable Saver and Spring-Shaped Flexible Cable Protecters, USB Cable Saver Phone Accessory Protect Charger Cable", published on or before Jan. 28, 2019 at https://www.amazon.com/TUPARKA-Protector-Spring-Shaped-Protecters-Accessory/dp/B082SR2317, retrieved from the internet on Jan. 28, 2019, 1 page filed herewith.

Cicig, "1Pcs USB Cable Protector Saver Earphone Cord Protection Wire Cover 8Pin Random Color Data Charger Line Protective Sleeve Hot" published on or before Jan. 28, 2019 at https://www.cicig.co/product/yiyc6ej2n, retrieved from the internet on Jan. 28, 2019, brand name: Wottler, 1 page filed herewith.

Ctam, "Chewsafe® Pet Resistant Cord Protector—Kable Kontrol™", published on or before Jan. 28, 2019 at https://www.cabletiesandmore.com/chewsafe-cord-cover?pid=1937, retrieved from the internet on Jan. 28, 2019, 1 page filed herewith.

Cults, "Iphone USB Cable Protector V2", published on or before Jan. 28, 2019 at https://cults3d.com/en/3d-model/gadget/iphone-usb-cable-protector-v2, retrieved from the internet on Jan. 28, 2019, 1 page filed herewith.

DHGATE, "Cute mobile phone charging cord protector usb cable mini head holder shockproof cable animal bites for phone cable free shipping hot sale", published on or before Jan. 28, 2019 at https://www.dhgate.com/product/cute-mobile-phone-charging-cord-protector/442481497.html, retrieved from the internet on Jan. 28, 2019, 1 page submitted herewith.

DHGATE, "Universal Saver USB Cable Protector Sleeve Android Mobile Phone Charger Cord Protector Cover Silicone for IPhone 7 6 plus Line Protective", published on or before Jan. 28, 2019 at https://www.google.com/imgres?imgurl=https%3A%2F%2Fwww.dhresource.com%2F0x0s%2Ff2-albu-g5-M00-D4-E5-rBVal1jkkPGAUmCkAANRUbrfCcc727.jpg%2Funiversal-saver-usb-cable-protector-sleeve.jpg&imgrefurl=https%3A%2F%2Fwww.dhgate.com%2Fproduct%2Funiversal-saver-usb-cable-protector-sleeve%2F397986831.

Ebay, "Cable Protector Saver for Apple iPhone iPad Lightning USB Charger | Cable Labels", published on or before Jan. 28, 2019 at https://www.ebay.co.uk/itm/Cable-Protector-Saver-for-Apple-iPhone-iPad-Lightning-USB-Charger-Cable-Labels-/282550281980, retrieved from internet on Jan. 28, 2019, 1 page filed herewith.

Ebay, "Lightning Cable Protector and Repair Sleeve for Apple iPhone 5, 5S, 6, 6 Plus" published on or before Jan. 28, 2019 at https://www.ebay.ie/itm/Lightning-Cable-Protector-and-Repair-Sleeve-for-Apple-iPhone-5-5S-6-6-Plus-/111651842098, retrieved from the internet on Jan. 28, 2019, 1 page filed herewith.

Ebay, "Lightning Cable Protector Sleeve for Apple iPhone 5, 5S, 6, 6 Plus", published on or before Jan. 28, 2019 at https://www.ebay.ie/itm/Lightning-Cable-Protector-Sleeve-for-Apple-iPhone-5-5S-6-6-Plus/111721535307, retrieved from the internet on Jan. 28, 2019, 2 pages filed herewith.

Kickstarter, "Apple Usb Cable Protector", published on or before Jan. 28, 2019 at https://www.kickstarter.com/projects/1509639859/apple-usb-cable-protector?ref=category_newest, retrieved from the internet on Jan. 28, 2019, 8 pages filed herewith.

Makerbot Thingiverse, "iphone 6 cable protector", published on or before Jan. 28, 2019 at https://www.thingiverse.com/thing:742415, retrieved from the internet on Jan. 28, 2019, 1 page filed herewith.

Newegg, "5pcs/lot Phone Charging Cable Protector USB Cord Protecotor Cover for iphone Samsung Headphone Cord Wires Protection Cable Clips", published on or before Jan. 28, 2019 at https://www.newegg.com/p/0X6-04KT-1ZD99#, retrieved from the internet on Jan. 28, 2019, brand name: ISAO Electronics, 1 page filed herewith.

I.pinimg.com, brand name: Wottler Electronic, published on or before Jan. 28, 2019 at https://i.pinimg.com/originals/d0/97/e7/d097e726f31c147b6696191bf57415d3.jpg, retrieved from the internet on Jan. 28, 2019, 1 page filed herewith.

Amazon, published on or before Jan. 28, 2019 at https://images-na.ssl-images-amazon.com/images/I/51kCabD3sLL._SX425_.jpg, retrieved from the internet on Jan. 28, 2019, 1 page field herewith.

* cited by examiner

FIGURE 17
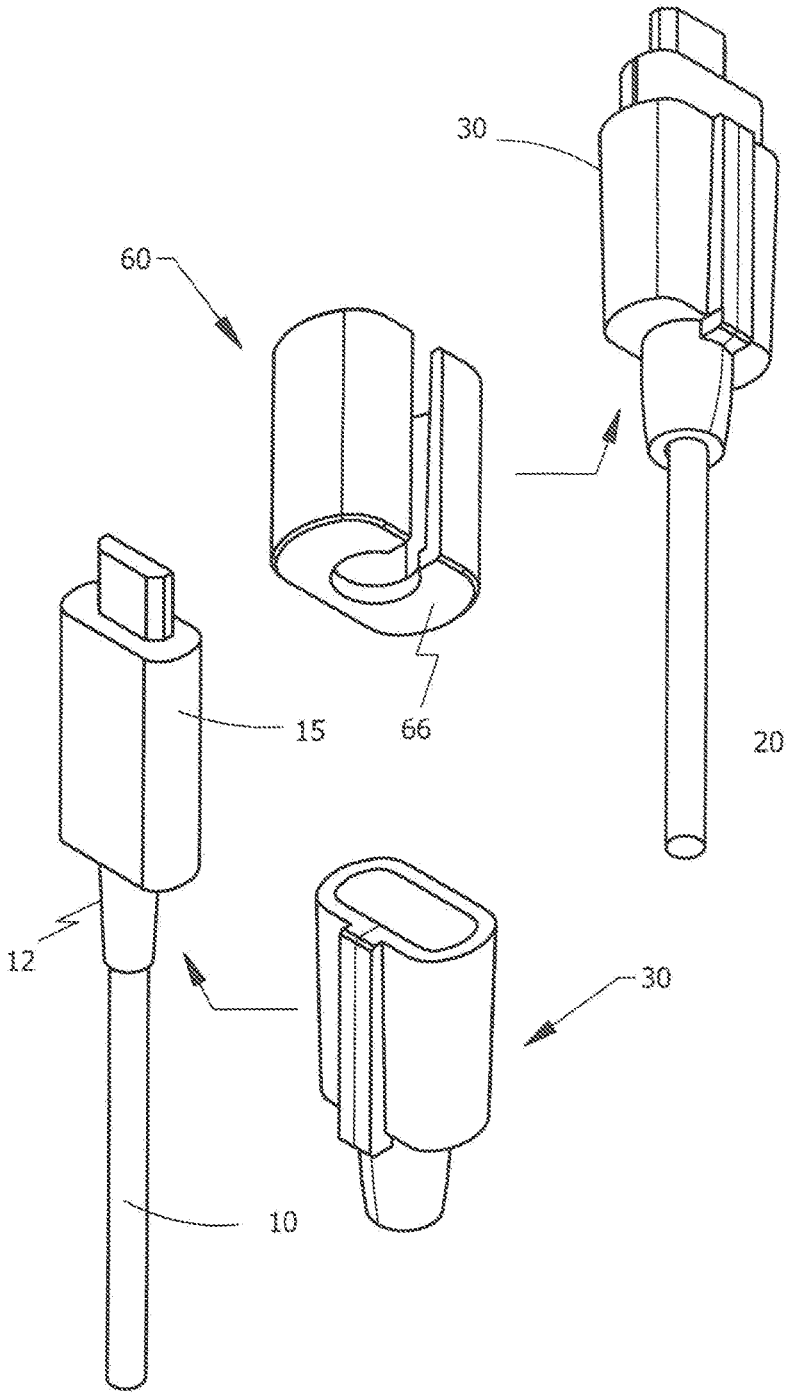
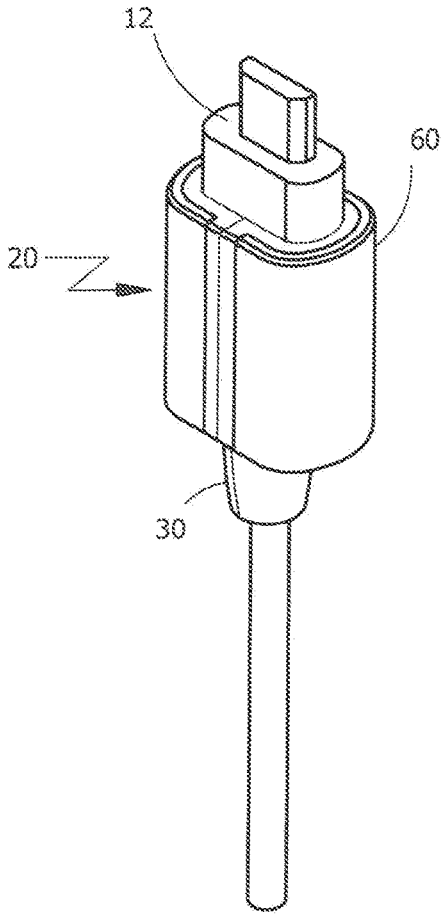
FIGURE 16
FIGURE 18

REMOVABLE-REPLACEABLE PROTECTOR AND METHOD

CROSS-REFERENCE TO RELATED APPLICATION

This application claims the benefit of U.S. Provisional Application No. 62/843,963, filed May 6, 2019, and titled: REMOVABLE-REPLACEABLE PROTECTOR AND METHOD.

TECHNICAL FIELD

This invention relates to power cords for electrical equipment and more specifically to a removable and replaceable protector for an already manufactured cable and plug to enhance the useful life of the power cord.

BACKGROUND

With the development of electrical devices, and electronic technology in particular, more and more power cables with plugs are used to operate and/or charge such devices. An especially high use item is the USB cable for a variety of devices like computers, mobile phones, a mouse's USB port, device charging, etc. Use of the cables can be quite intense and over time the cables tend to fail at their weakest point, the junction location where the cable joins the plug. Plugs have tried to prevent this by extending a portion of the plug, like a neck or other part of the plug to help with the transition from the cable itself to, next to, and then inside, the housing of the plug. However, such does not overcome the fact that there has to be a junction between the plug and the cable to allow each part to perform its intended function, and at a reasonable cost. A user's continued and repetitive use of cables with plugs, most exemplified in USB cables for hand-held devices, and such devices stored in a pocket, backpack, briefcase or other location often subject to movement and jostling around, results in fraying, crimping, etc., and eventual failure of the cable at the junction location near the plug and/or just outside of the plug.

A variety of prior structures and approaches have been used to try and prevent the fraying and/or failure near the junction where the cable joins the plug, but none are sufficient and efficient to do this consistently. Accordingly, there is need for a better device and method to address one or more shortcomings of the existing solutions.

SUMMARY

To address one or more of the above described deficiencies or another need, there is provided a removable-replaceable protector for a cable secured to a plug. The protector includes a resiliently-flexible sleeve positionable over the cable and the plug, including at a junction location where the cable joins the plug. The resiliently-flexible sleeve has a longitudinal slit extending along the resiliently-flexible sleeve to enable the resiliently-flexible sleeve to be removable and replaceable over the cable and plug. The protector also includes a resiliently-rigid clip positionable over the resiliently-flexible sleeve and super imposed over the plug. The resiliently-rigid clip has a longitudinal slot extending along the resiliently-rigid clip.

In another embodiment the protector comprises a removable-replaceable protector for a cable secured to a plug. The protector includes a resiliently-flexible sleeve positionable over the cable and the plug, including at a junction location where the cable joins the plug. The resiliently-flexible sleeve has a longitudinal slit extending along the resiliently-flexible sleeve to enable the resiliently-flexible sleeve to be removable and replaceable over the cable and plug. The protector also includes a resiliently-rigid clip positionable over the resiliently-flexible sleeve and super imposed over the plug. The resiliently-rigid clip has a longitudinal slot extending along the resiliently-rigid clip to enable the resiliently-rigid clip to be removable and replaceable over the plug. A protrusion is on the resiliently-flexible sleeve and super imposed over the plug. The longitudinal slot is sized to receive the protrusion. The resiliently-flexible sleeve frictionally engages at least one of the cable and the plug when the resiliently-flexible sleeve is positioned over the cable and the plug. The resiliently-rigid clip frictionally engages the resiliently-flexible sleeve when the resiliently-rigid clip is positioned over the resiliently-flexible sleeve.

In still another embodiment of the protector, there is provided a removable-replaceable protector for a cable secured to a plug. The protector includes a resiliently-flexible sleeve positionable over the cable and the plug, including at a junction location where the cable joins the plug. The resiliently-flexible sleeve has a longitudinal slit extending along the resiliently-flexible sleeve to enable the resiliently-flexible sleeve to be removable and replaceable over the cable and plug. The protector also includes a resiliently-rigid clip positionable over the resiliently-flexible sleeve and super imposed over the plug. The resiliently-rigid clip has a longitudinal slot extending along the resiliently-rigid clip. A circumferential ridge is on the resiliently-flexible sleeve extending outward from the resiliently-flexible sleeve to limit a position of the resiliently-rigid clip relative to the resiliently-flexible sleeve. The resiliently-flexible sleeve frictionally engages at least one of the cable and the plug when the resiliently-flexible sleeve is positioned over the cable and the plug. The resiliently-rigid clip frictionally engages the resiliently-flexible sleeve when the resiliently-rigid clip is positioned over the resiliently-flexible sleeve.

Other aspects of the protector are directed to the one or more of the following features with any of the preceding embodiments: the size and orientation of the resiliently-flexible sleeve and the resiliently-rigid clip, for example, to enhance interaction with each other and/or the cable and the plug when these are positioned over the cable and the plug. Additionally, there can be a protrusion on the resiliently-flexible sleeve, its structure and orientation, and its relation to the longitudinal slot and its size and the orientation, and these relative to each other. Still additionally or alternately, there can be a circumferential ridge on the resiliently-flexible sleeve to help position the resiliently-rigid clip relative to the resiliently-flexible sleeve, and location of the ridge relative to the plug and/or the clip and in relation to the protrusion.

In yet another embodiment of the protector, there is a method of protecting a cable secured to a plug with a removable-replaceable protector. One step is positioning a resiliently-flexible sleeve over the cable and the plug, including at a junction location where the cable joins the plug. The resiliently-flexible sleeve has a longitudinal slit extending along the resiliently-flexible sleeve to enable the resiliently-flexible sleeve to be removable and replaceable over the cable and plug. Another step is positioning a resiliently-rigid clip over the resiliently-flexible sleeve and super imposed over the plug, the resiliently-rigid clip having a longitudinal slot extending along the resiliently-rigid clip.

Some additional, preferred, features relating to the method include steps to how parts of the protector interact with each other and the cable and plug. For example, frictionally engaging the cable, the plug and/or the sleeve when the resiliently-flexible sleeve is positioned over the cable and the plug, and/or the resiliently-rigid clip is positioned over the resiliently-flexible sleeve. Additionally or alternately, removing at least one of the resiliently-flexible sleeve and the resiliently-rigid clip from over the cable and plug without damaging the cable and the plug and/or without damaging at least one of the resiliently-flexible sleeve and the resiliently-rigid clip.

BRIEF DESCRIPTION OF THE DRAWINGS

The protector may be more completely understood in consideration of the following detailed description of various embodiments of the protector in connection with the accompanying drawings, in which:

FIG. 16 is an assembly view of an alternate embodiment of the resiliently-flexible sleeve of the protector about to be positioned over the prior art cable;

FIG. 17 is an assembly view of an alternate embodiment of the resiliently-rigid clip of the protector about to be positioned over the alternate embodiment resiliently-flexible sleeve of the protector that is already positioned over the cable and the plug in FIG. 16; and, FIG. 18 is an assembly view of the elements in FIG. 17, now with the resiliently-rigid clip and the resiliently-flexible sleeve fully assembled together and positioned over the cable and the plug.

Figure 1:
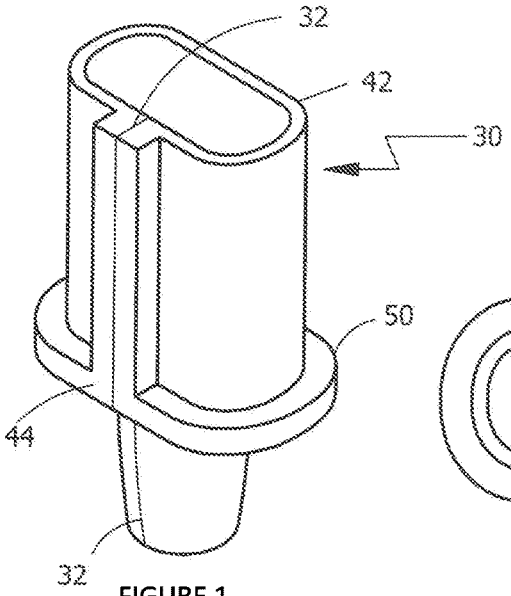
FIG. 1 is a perspective view of the resiliently-flexible sleeve of the protector.
Figure 5:
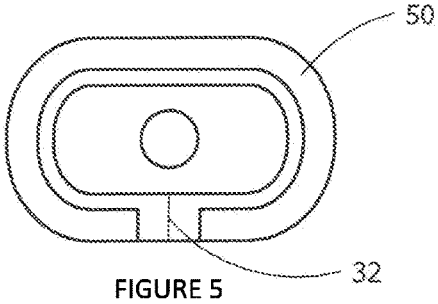
FIG. 5 is a top view of the plug end of the sleeve in FIG. 1.
Figure 2:
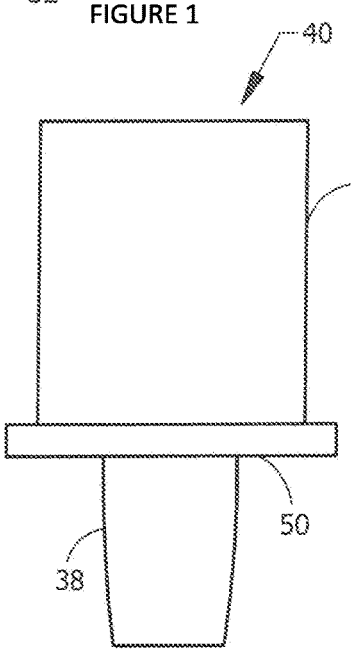
FIG. 2 is a top view of a back surface of the sleeve in FIG. 1.
Figure 3:
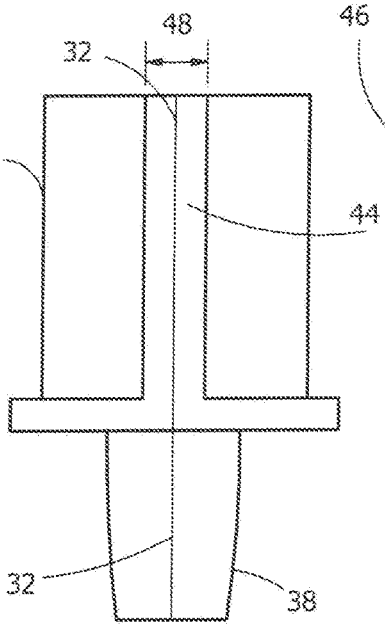
FIG. 3 is a top view of a front surface of the sleeve in FIG. 1.
Figure 4:
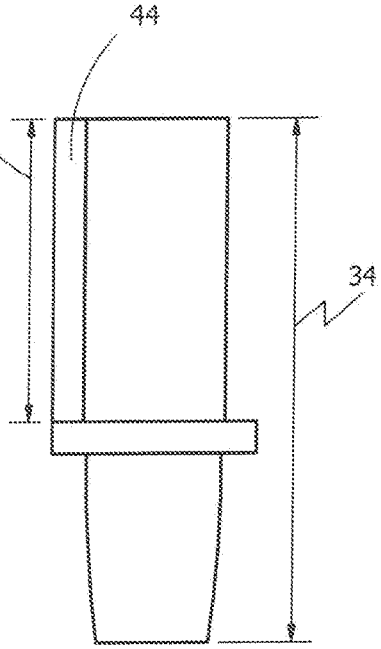
FIG. 4 is a top view of a side surface of the sleeve in FIG. 1, where the opposite side view is a mirror image thereof.
Figure 6:
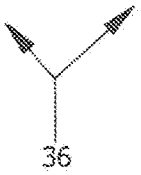
FIG. 6 is a top view of the cable end of the sleeve in FIG. 1.
Figure 6:
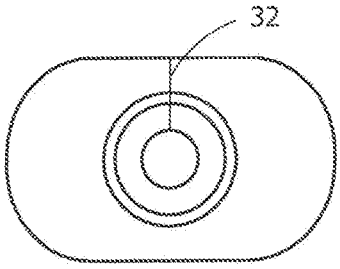
Figure 7:
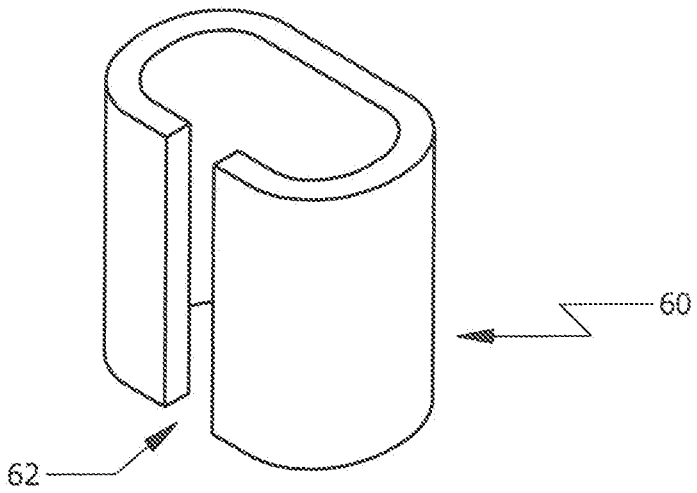
FIG. 7 is a perspective view of the resiliently-rigid clip of the protector.
Figure 9:
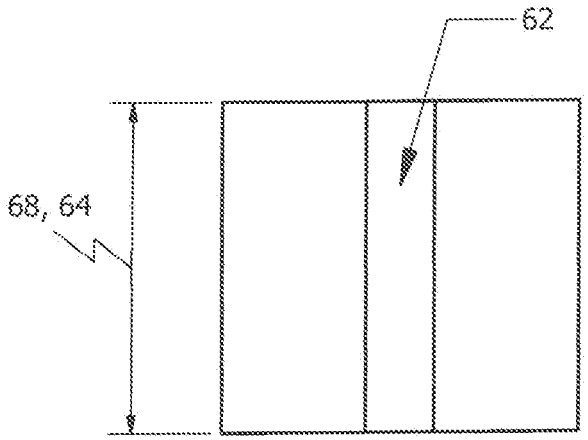
FIG. 9 is a top view of a front surface of the sleeve in FIG. 7.
Figure 10:
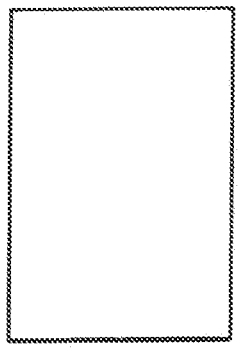
FIG. 10 is a top view of a side surface of the clip in FIG. 7, where the opposite side view is a mirror image thereof.
Figure 8:
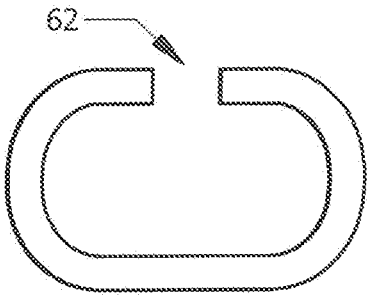
FIG. 8 is a top view of an end of the clip in FIG. 7, where the opposite end is a mirror image thereof.
Figure 12:
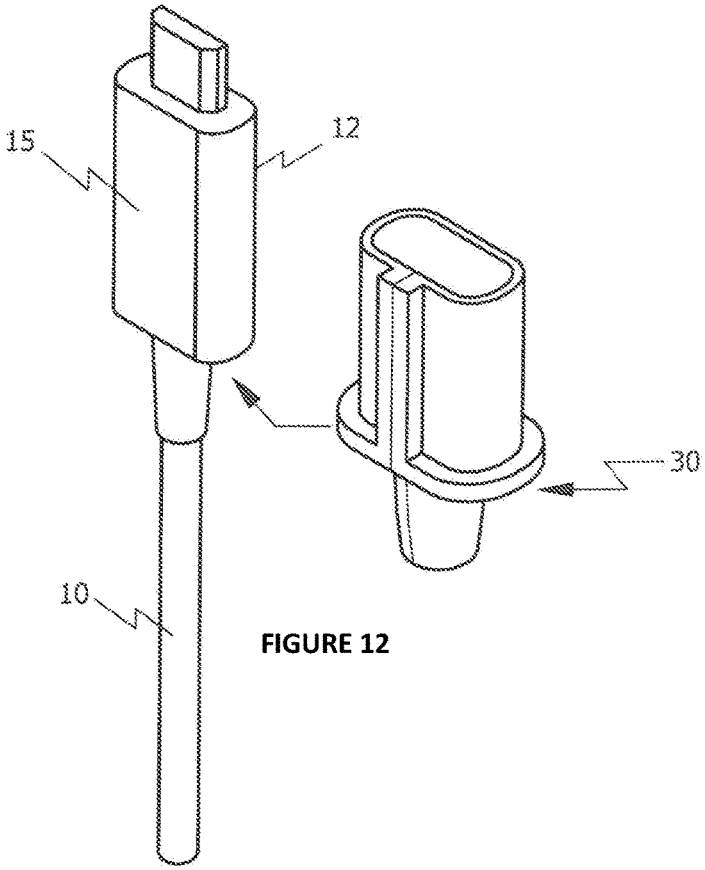
FIG. 12 is an assembly view of the resiliently-flexible sleeve of the protector about to be positioned over the prior art cable.
Figure 13:
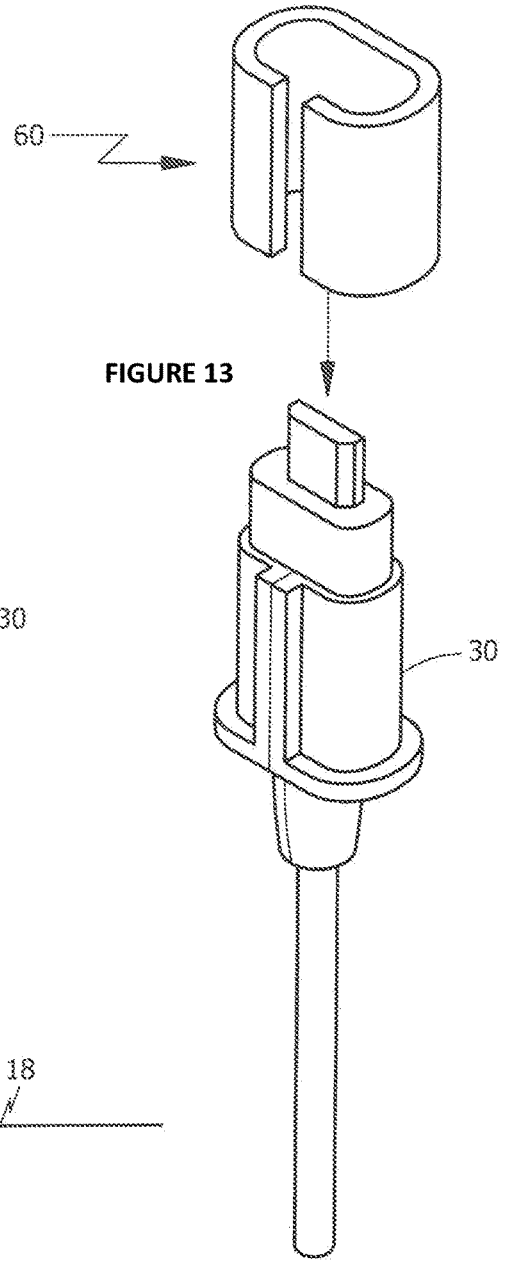
FIG. 13 is an assembly view of the resiliently-rigid clip of the protector about to be positioned over the resiliently-flexible sleeve of the protector that is already positioned over the cable and the plug in FIG. 12.

The drawings show some but not all embodiments. The elements depicted in the drawings are illustrative and not necessarily to scale, and the same (or similar) reference numbers denote the same (or similar) features throughout the drawings.

DETAILED DESCRIPTION

Figure 11:
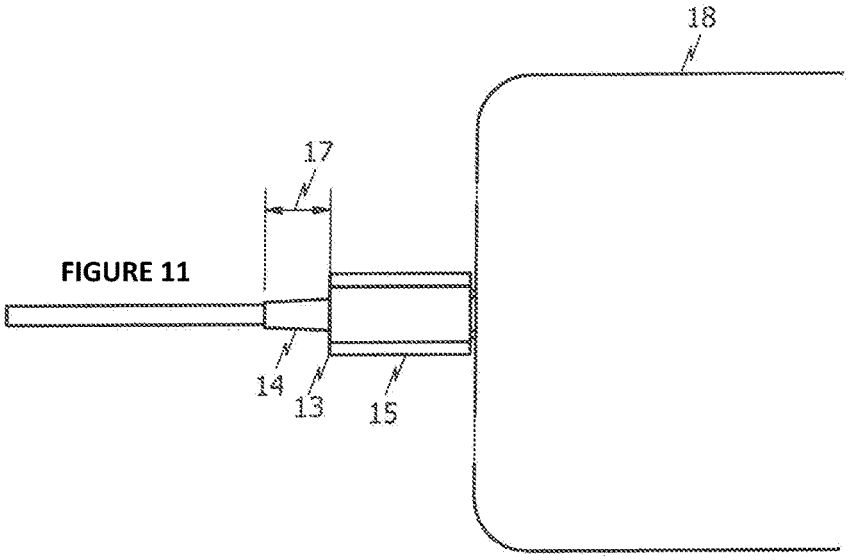
FIG. 11 is a top view of prior art electrical equipment depicting the cable and the plug secured into the hand-held device.
Figure 14:
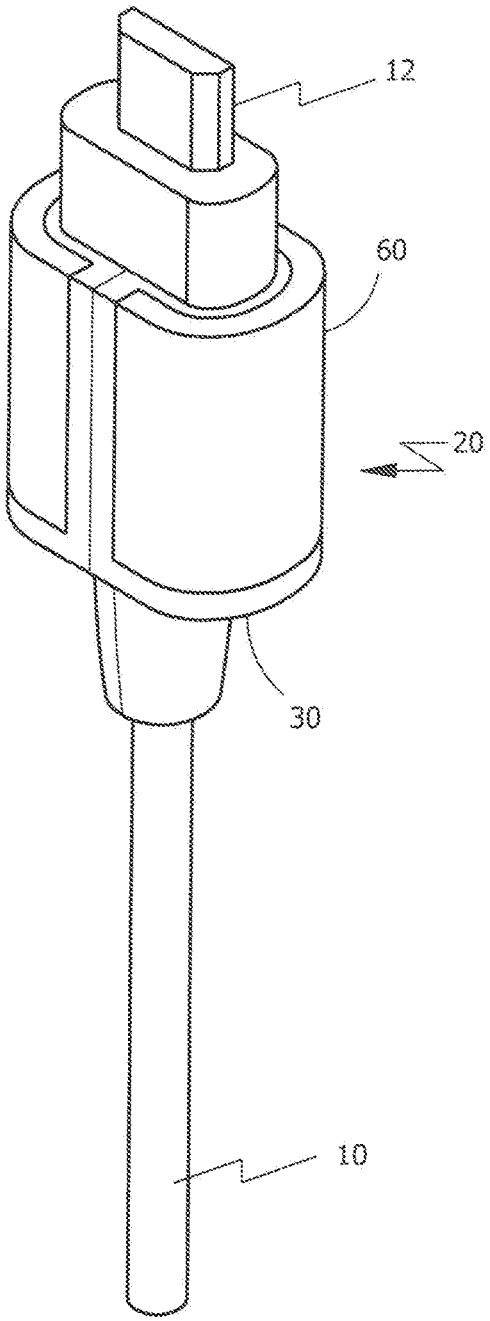
FIG. 14 is an assembly view of the elements in FIG. 13, now with the resiliently-rigid clip and the resiliently-flexible sleeve fully assembled together and positioned over the cable and the plug.
Figure 15:
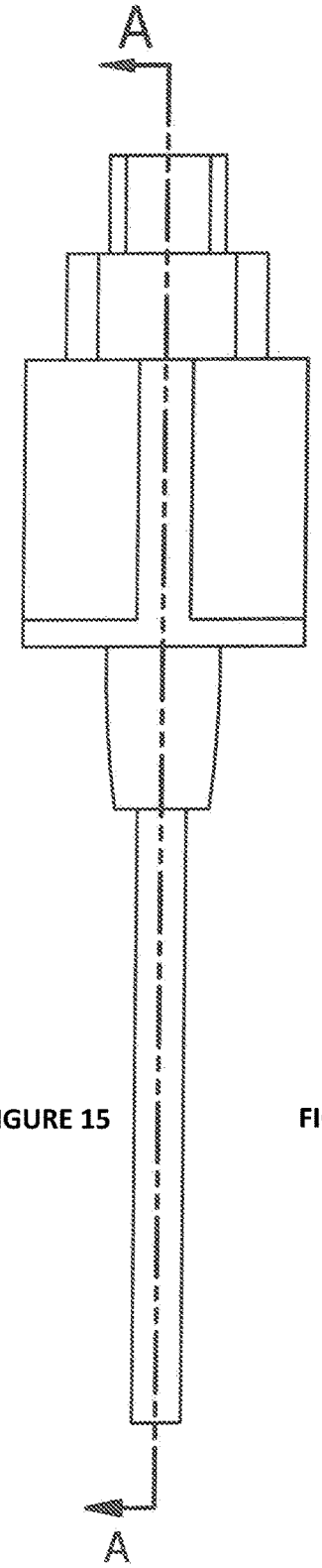
FIG. 15 is a front view of that seen in FIG. 14.
Figure 15A:
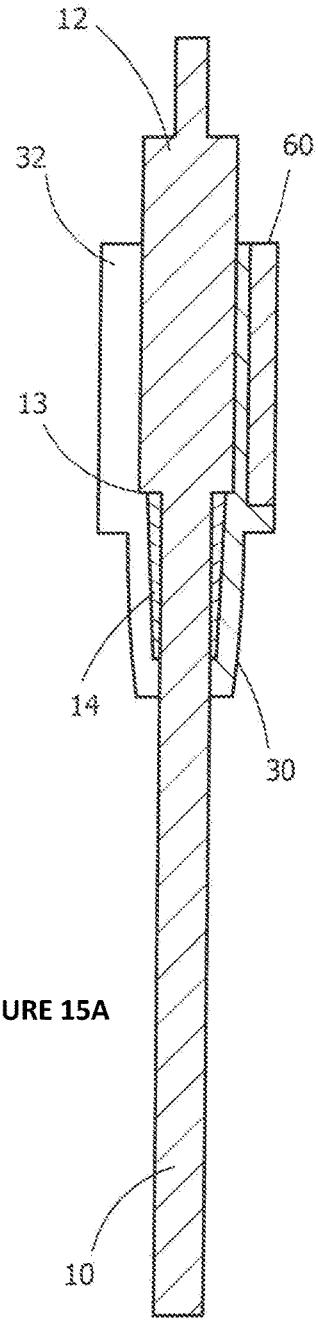
FIG. 15A is a cross-sectional view of that seen in FIG. 15, taken along the line A-A.

In accordance with the practice of at least one embodiment of the protector, for example see FIGS. 1, 7 and 12-14, the protector is a removable-replaceable protector 20 for a cable 10 secured to a plug 12. The plug 12 includes all parts of the plug that are separate from the cable 10, for example, the shoulder 13, narrower portion 14 and main body 15, as seen in FIG. 11. Preferably protector 20 retro-fits to existing cable and plug equipment with minimal to no modification of the existing equipment. As such, the protector can be used with and on the existing equipment after the equipment's complete manufacture as a finished product sold to and used by a consumer. For example, the protector 20 is particularly useful for a USB cable and plug equipment of a hand-held device 18 like an iPhone®, iPad®, Android®, etc.

Protector 20 also includes a resiliently-flexible sleeve 30 positionable over the cable 10 and the plug 12 including at a junction location where the cable joins the plug. The plug is often made of a material of greater rigidity than the cable. The plug may include different thickness portion(s) which helps with the transition between the plug and the cable to enhance the flexibility of the plug relative to the cable at the junction location. The junction location is defined at the end of the plug that receives the cable, and has a length 17 when the end includes a narrower portion 14 (if any) and shoulder 13 that joins to the largest circumference of the plug such as main body 15, as seen in FIG. 11. Alternately, when plug 12 has no narrower portion, the cable 10 joins right into the plug at shoulder 13 and the length 17 is effectively zero (not shown). The sleeve 30 has a longitudinal slit 32 extending along the sleeve to enable the sleeve to be removable from and replaceable over the cable and plug.

The protector 20 further includes resiliently-rigid clip 60 positionable over resiliently-flexible sleeve 30 and super imposed over the plug. The resiliently-rigid clip is super imposed over any portion of the main body of the plug and preferably over substantially all of the main body of the plug. In another embodiment, the resiliently-rigid clip can be super imposed over the junction location 14 as well as the main body 15, and preferably only as far as the outer edge of the shoulder 13 near the narrower portion 14. The resiliently-rigid clip can have a longitudinal slot 62 extending along the resiliently-rigid clip. For example, this can help enable the sleeve to be removable from and replaceable over the cable and the plug, if desired.

Another aspect of the resiliently-rigid clip concerns the material used to make clip 60. In this regard, it is important that any material chosen be able to give the clip both its resilient and rigid characteristics. The clip is rigid in that, except for orthogonal-squeezing or orthogonal-pushing described next, the clip is substantially not bendable, twistable, squeezable, stretchable, or in other ways deformable by an external force under manual hand manipulation by one of ordinary skill in the art that uses and/or tests hand held electrical equipment. The clip is also resilient in that when one of ordinary skill in the art that uses and/or tests hand held electrical equipment applies (i) an orthogonal-squeezing external force or (ii) an orthogonal-pushing internal force, e.g. to cause the longitudinal slot 62 to be (i) narrowed by compression (squeezing) inward on the outside walls of the clip or (ii) widened by compression outward on the inside walls of the clip, when the external/internal force is released from the clip then the clip returns to substantially its original shape, and preferably returns to at least 80%, and most preferably up to and including 100%, of its original shape before being subject to the external/internal force. For example, various plastics and/or metals can be used, provided the materials are thick/thin enough and provide the needed structure, configuration and characteristics taught as the protector. Some exemplary plastics can be Polypropylene, PLA (Polyactic Acid), and ABS (Acrylonitrile Butadiene Styrene).

Of particular importance to protector 20 is its removable and replaceable features, which are due, at least in part, to the longitudinal slit 32, longitudinal slot 62, the material(s) making them, and/or the interactions between slit 32 and slot 62. As such, at least one of, and preferably both of, the resiliently-flexible sleeve and the resiliently-rigid clip can be removed from over the cable and plug without damaging the cable and the plug. Still further in this regard, at least one of, and preferably both of, the resiliently-flexible sleeve and the resiliently-rigid clip can be removed from over the cable and plug without damaging at least one of, and preferably both of, the resiliently-flexible sleeve and the resiliently-rigid clip.

Other features of the protector are directed to the configuration and structure of resiliently-flexible sleeve 30 itself, and with resiliently-rigid clip 60. The resiliently-flexible sleeve has a cable end 36 and a plug end 40. Cable end 36 can have a smaller circumference 38 than a circumference 42 of plug end 40. Smaller circumference 38 is designed to correspond to the cable inside the resiliently-flexible sleeve near cable end 36. Circumference 42 is designed to correspond to the outer circumference of the plug inside near plug end 40 and, for example, where the resiliently-flexible sleeve is super imposed over the plug, such as at main body 15. With these circumference particulars, unlike ever before, applicant has discovered that protector 20 serves to better shield cable 10 from damaging exposure and/or harmful forces at and near the junction location, thereby enhancing longevity and proper functionality of cable 10, especially at this location relative to the plug.

Further in this regard, the resiliently-flexible sleeve 30 can preferably frictionally engage at least one of, and most preferably both of, the cable 10 and the plug 12 when the resiliently-flexible sleeve is positioned over the cable and the plug. Still further, the resiliently-rigid clip 60 can preferably frictionally engage the resiliently-flexible sleeve 30 when the resiliently-rigid clip is positioned over the resiliently-flexible sleeve. Yet still further, and even more preferably, when the resiliently-rigid clip 60 frictionally engages the resiliently-flexible sleeve 30 and the resiliently-rigid clip is positioned over the resiliently-flexible sleeve, this also enhances how the resiliently-flexible sleeve frictionally engages at least one of, and preferably both of, the cable and the plug when the resiliently-flexible sleeve is positioned over the cable and the plug.

Still other features of the resiliently-flexible sleeve concern the material used to make resiliently-flexible sleeve 30. In this regard, it is important that any material chosen be able to give the sleeve both its resilient and flexible characteristics. The sleeve is flexible in that it can be easily bent, twisted, squeezed, stretched to some extent as long as such does not tear or permanently strain the material, or in other ways acted upon by an external force under manual hand manipulation by one of ordinary skill in the art that uses and/or tests hand held electrical equipment. The sleeve is also resilient in that when the external force applied to the sleeve is released from the sleeve then the sleeve returns to substantially its original shape and size, and preferably returns to at least 80%, and most preferably up to and including 100%, of its original shape and size before being subject to the external force. For example, both these properties can be achieved when the resiliently-flexible sleeve is made of elastomeric material. More particularly, the elastomeric material can be a formed rubber-like material, which includes rubber, rubber derivatives, other materials including rubber that act like a rubber material and materials not containing any rubber but that still act like a rubber material in their resilience and flexibility. While not limited to a particular composition or class of chemicals, particularly useful elastomeric material for the protector can be Smooth-On® Mold Star™ 19 T platinum silicone rubber (and it can have around a Shore 30 A hardness).

Additional features of the protector are related to the protrusion 44 on the resiliently-flexible sleeve and the longitudinal slot 62 sized to receive the protrusion 44. The protrusion preferably has a length 46 greater than a width 48 of the protrusion 44, and the protrusion extends in a longitudinal direction 34 of the resiliently-flexible sleeve 30. Without being limited to a theory of explanation, the protrusion and slot act like a zipper to locate and seal up the longitudinal slit even better than without these features, when the removable-replaceable protector is in place over the cable and plug. Preferably, the longitudinal slot 62 is sized to substantially equal the width 48 of the protrusion 44. Alternatively, and also preferable, the longitudinal slot 62 may frictionally engage the protrusion 44 along the length 46 of the protrusion, e.g., for even better sealing of the slit 32 and overall engagement with the plug therein. The length of the protrusion may be substantially equal to a length 64 of the longitudinal slot. The longitudinal slit 32 of the sleeve can, preferably, be located within the longitudinal slot 62 of the resiliently-rigid clip 60. Alternatively, the slit 32 could be at another location (not shown) around the perimeter of the resiliently-flexible sleeve and held in place under the resiliently-rigid clip opposite (not shown) a solid wall of the clip.

Still other features of the protector concern the circumferential ridge 50 on the resiliently-flexible sleeve 30 extending outward from the resiliently-flexible sleeve. For example, the ridge 50 can limit a position of the resiliently-rigid clip relative to the resiliently-flexible sleeve. The circumferential ridge can be located between ends of the sleeve, as desired, to particularly locate the clip relative to the sleeve and also relative to the plug under lying the sleeve and clip. Further in this regard, preferably the circumferential ridge is located a distance from one end of the sleeve that is equal to a length 68 of the resiliently-rigid clip, which is the same as length 64 of the slot when both are parallel but would differ if the slot were non-parallel to the length 68. The circumferential ridge can adjoin the protrusion to enhance the function of both the ridge and the protrusion. Additionally or alternatively, and at least in part for reasons similar to the ridge 50, the resiliently-rigid clip can have an end wall 66 that limits a position of the resiliently-rigid clip relative to the resiliently-flexible sleeve, as seen in FIG. 17.

The protector also includes a method of protecting the cable 10 secured to the plug 12 with the removable-replaceable protector 20. A first step is positioning the resiliently-flexible sleeve 30 over the cable and the plug including at the junction location 16 where the cable joins the plug. The sleeve has the longitudinal slit 32 extending along the sleeve to enable the sleeve to be removable and replaceable over the cable and plug. Next, is positioning the resiliently-rigid clip 60 over the resiliently-flexible sleeve 30 and super imposed over the plug 12. The resiliently-rigid clip has a longitudinal slot 62 extending along the resiliently-rigid clip to enable the sleeve 30 to be removable and replaceable over the cable and/or the plug.

In other aspects of the method, it may include the step frictionally engaging the resiliently-flexible sleeve when the resiliently-rigid clip is positioned over the resiliently-flexible sleeve. Additionally, or alternatively, it may include removing at least one of the resiliently-flexible sleeve and the resiliently-rigid clip from over the cable and plug without damaging the cable and the plug. Additionally, or alternatively, it may include removing at least one of the resiliently-flexible sleeve and the resiliently-rigid clip from over the cable and plug without damaging at least one of the resiliently-flexible sleeve and the resiliently-rigid clip. Additionally, or alternatively, in the method the removable-replaceable protector may include a protrusion on the resiliently-flexible sleeve, and/or engaging the protrusion into the longitudinal slot. Additionally, or alternatively, the method may include the removable-replaceable protector including a circumferential ridge on the resiliently-flexible sleeve, and/or locating the resiliently-rigid clip against the circumferential ridge. Other aspects of the method have been discussed above in reference to the removable-replaceable protector and are applicable here as well.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present disclosure includes the description, examples, embodiments, and drawings; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the electrical cable arts, and all such modifications and other embodiments are intended and deemed to be within the scope of the present invention.

What is claimed is:

1. A removable-replaceable protector for a length of cable secured to a plug, comprising:

a resiliently-flexible sleeve positionable over the length of cable and the plug including at a junction location where the length of cable joins the plug, the resiliently-flexible sleeve having a longitudinal slit extending along the resiliently-flexible sleeve to enable the resiliently-flexible sleeve to be removable and replaceable over the length of cable and plug; and, a resiliently-rigid clip positionable over the resiliently-flexible sleeve and super imposed over the plug, the resiliently-rigid clip having a longitudinal slot extending along an entire length of the resiliently-rigid clip, wherein the longitudinal slit and the longitudinal slot each extend longitudinally in a same direction as the length of cable positionable within the resiliently-flexible sleeve.

2. The removable-replaceable protector of claim 1, wherein the resiliently-flexible sleeve has a cable end and a plug end, and the cable end has a smaller circumference than a circumference of the plug end.

3. The removable-replaceable protector of claim 1, wherein the resiliently-flexible sleeve frictionally engages at least one of the length of cable and the plug when the resiliently-flexible sleeve is positioned over the length of cable and the plug.

4. The removable-replaceable protector of claim 1, wherein the resiliently-rigid clip frictionally engages the resiliently-flexible sleeve when the resiliently-rigid clip is positioned over the resiliently-flexible sleeve.

5. The removable-replaceable protector of claim 3, wherein the resiliently-rigid clip frictionally engages the resiliently-flexible sleeve when the resiliently-rigid clip is positioned over the resiliently-flexible sleeve and this also enhances how the resiliently-flexible sleeve frictionally engages at least one of the length of cable and the plug when the resiliently-flexible sleeve is positioned over the length of cable and the plug.

6. The removable-replaceable protector of claim 1, comprising a protrusion on the resiliently-flexible sleeve super imposed over the plug and the longitudinal slot sized to receive the protrusion.

7. The removable-replaceable protector of claim 6, wherein the protrusion has a length greater than a width of the protrusion and the protrusion extends in a longitudinal direction of the resiliently-flexible sleeve.

8. The removable-replaceable protector of claim 7 wherein the longitudinal slot is sized to substantially equal the width of the protrusion.

9. The removable-replaceable protector of claim 8, wherein the longitudinal slot frictionally engages the protrusion along the length of the protrusion.

10. The removable-replaceable protector of claim 7, wherein the length of the protrusion is substantially equal to a length of the longitudinal slot.

11. The removable-replaceable protector of claim 1, wherein the resiliently-rigid clip has an end wall that limits a position of the resiliently-rigid clip relative to the resiliently-flexible sleeve.

12. The removable-replaceable protector of claim 1, comprising a circumferential ridge on the resiliently-flexible sleeve extending outward from the resiliently-flexible sleeve to limit a position of the resiliently-rigid clip relative to the resiliently-flexible sleeve.

13. The removable-replaceable protector of claim 12, wherein the circumferential ridge is located between ends of the resiliently-flexible sleeve.

14. The removable-replaceable protector of claim 13, wherein the circumferential ridge is located a distance from one end of the resiliently-flexible sleeve that is equal to a length of the resiliently-rigid clip.

15. The removable-replaceable protector of claim 12, wherein the circumferential ridge adjoins with the protrusion.

16. The removable-replaceable protector of claim 1, wherein the resiliently-rigid clip is super imposed over the junction location where the length of cable joins the plug.

17. The removable-replaceable protector of claim 1, wherein the length of cable is a USB cable and the plug is for a hand-held device.

18. The removable-replaceable protector of claim 1, wherein the resiliently-flexible sleeve is an elastomeric material.

19. The removable-replaceable protector of claim 18, wherein the elastomeric material is a formed rubber-like material.

20. The removable-replaceable protector of claim 1, wherein the longitudinal slit of the resiliently-flexible sleeve is located within the longitudinal slot of the resiliently-rigid clip.

21. A removable-replaceable protector for a cable secured to a plug, comprising:

a resiliently-flexible sleeve positionable over the cable and the plug including at a junction location where the cable joins the plug, the resiliently-flexible sleeve having a longitudinal slit extending along the resiliently-flexible sleeve to enable the resiliently-flexible sleeve to be removable and replaceable over the cable and plug;

a protrusion on the resiliently-flexible sleeve super imposed over the plug and the longitudinal slot sized to receive the protrusion; and, a resiliently-rigid clip positionable over the resiliently-flexible sleeve and super imposed over the plug, the resiliently-rigid clip having a longitudinal slot extending along the resiliently-rigid clip.

22. A removable-replaceable protector for a cable secured to a plug, comprising:

a resiliently-flexible sleeve positionable over the cable and the plug including at a junction location where the cable joins the plug, the resiliently-flexible sleeve having a longitudinal slit extending along the resiliently-flexible sleeve to enable the resiliently-flexible sleeve to be removable and replaceable over the cable and plug; and, a resiliently-rigid clip positionable over the resiliently-flexible sleeve and super imposed over the plug, the resiliently-rigid clip having a longitudinal slot extending along the resiliently-rigid clip and wherein the longitudinal slit of the resiliently-flexible sleeve is located within the longitudinal slot of the resiliently-rigid clip.

* * * * *